US005393248A

United States Patent [19]

Yagi et al.

[11] Patent Number: 5,393,248

[45] Date of Patent: Feb. 28, 1995

[54] CONNECTOR HAVING A TERMINAL ENGAGING LANCE

[75] Inventors: Sakai Yagi; Keishi Jinno, both of Shizuoka, Japan

[73] Assignee: Yazaki Corporation, Tokyo, Japan

[21] Appl. No.: 96,436

[22] Filed: Jul. 26, 1993

[30] Foreign Application Priority Data

Jul. 24, 1992 [JP] Japan ..... 4-218208

[51] Int. Cl.[6] ..... H01R 13/422

[52] U.S. Cl. ..... 439/595

[58] Field of Search ..... 439/489, 595, 752

[56] References Cited

U.S. PATENT DOCUMENTS 4,944,696 7/1990 Sueyoshi et al. ..... 439/595
4,975,082 12/1990 Nagasaka et al. ..... 439/595
5,127,854 7/1992 Fujianti et al. ..... 439/752

FOREIGN PATENT DOCUMENTS 63-131074 8/1988 Japan ..... 439/595

*Primary Examiner*—Edward K. Look
*Assistant Examiner*—Michael S. Lee
*Attorney, Agent, or Firm*—Sughrue, Mion, Zinn, Macpeak & Seas

[57] ABSTRACT

A connector 1 is so formed that a terminal 3 inserted into a connector housing 2 is held within the connector housing by being latched by a holding projection arranged on a front end portion of a housing lance 6 and that flexion of the housing lance is regulated by a strip 12 for preventing a terminal from coming out, such strip being inserted from the front end side of the housing lance into a lance flexion gap. A stepped portion 10 having a holding surface 10*a* is formed on a front end 8 of the housing lance. The holding surface 10*a* faces the rear side of the housing lance. The connector housing has a projecting wall 11 on the inner surface thereof, the projecting wall 11 having a confronting holding surface 11*a*. The confronting holding surface 11*a* is arranged at a position substantially confronting the holding surface 10*a* and can abut against the holding surface. When the front end of the strip 12 has pushed the front end of the housing lance 6, the holding surface 10*a* abuts against the confronting holding surface 11*a* so as to regulate the positioning of the front ends.

2 Claims, 3 Drawing Sheets

CONNECTOR HAVING A TERMINAL ENGAGING LANCE

BACKGROUND OF THE INVENTION

The invention relates to connectors used in connecting wire harnesses and the like and having such a design that connecting terminals are held within a connector housing. More particularly, the invention is directed to a connector of such a type that connecting terminals are held by a holding projection arranged on a housing lance that projects so as to be cantilever-like in the direction of inserting or extracting the terminals into or from the connector housing.

Various types of connectors have heretofore been used in wire harnesses and in other fields. A typical such connector is shown in FIG. 7.

A connector 30 shown in FIG. 7 includes a housing lance 6 that projects so as to be cantilever-like in the direction of inserting a terminal into a connector housing 2. A male terminal 4 (connected to a not shown lead) and a female terminal 3 (connected to a lead 20) are connected within the connector housing 2. The female terminal 3 accommodated in the terminal accommodating chamber 9 of the connector housing 2 gets held within the connector housing 2 by a holding projection 7 that has been fitted into a stepped portion or a hole formed on the bottom of the female terminal 3. The holding projection 7 is formed at a position closer to the front end (free end side) of the housing lance 6.

A male terminal holder 5 has a strip 12 for preventing a terminal from coming out (hereinafter referred to as "the strip 12"). The strip 12 extends forwardly along the bottom of male terminal 4. The strip 12 is arranged so as to enter into a lance flexion gap 16 when the male terminal 4 is inserted into the connector housing. That is, when the plate-like strip 12 is inserted into the lance flexion gap 16 provided between the housing lance 6 and a bottom inner wall 15 of the connector housing 2, the housing lance 6 cannot be flexed downward, thereby preventing the female terminal 3 from being coming out.

In the conventional connector, incomplete insertion of the female terminal 3 is sensed by the following way. When one tries to insert the strip 12 into the lance flexion gap 16 under the condition that the female terminal 3 has been inserted incompletely or that the front end portion of the housing lance 6 stays at a position lower than the normal position due to forming errors or the like, the front end portion of the housing lance abuts against the front end of the strip 12, thus blocking the insertion of the strip 12. Such condition that the insertion of the strip 12 is blocked is sensed as the female terminal being inserted incompletely.

However, the housing lance 6 and the strip 12 are formed integrally with the connector housing and the terminal holder, respectively. Thus, these members are relatively thin and small. In addition, the housing lance 6 comes in contact with the strip 12 at such a small portion that these members are liable to deformation or damage when a force that is stronger than necessary is applied at the time of inserting the male terminal 4, even through such force is not so strong. As a result, even in the case where the strip 12 should function as a sensor for sensing incomplete insertion as the strip 12 has not entered into the lance flexion gap 16, the male terminal 4 is allowed to be inserted due to the deformation or damage of the housing lance 6, thereby imposing the problem that the incomplete insertion of the female terminal 3 cannot be sensed.

Proposed under these circumstances is a connector having such a structure that a surface 8*a* for ushering the front end portion of the strip 12 is formed at the front end of the housing lance 6 and that an inclined ushering surface 12*a* formed by appropriately tapering or chamfering the front end portion of the strip 12 is arranged as shown in FIG. 7 (Japanese Utility Model Unexamined Publication No. 131074/1988). This design allows the inclined ushering surface 12*a* to be positioned on the ushering surface 8*a* as shown in FIG. 7 when a front end 8 of the housing lance 6 happens to abut against the front end portion of the strip 12, thereby improving the function of sensing the incomplete insertion of the terminals.

However, while the arrangement disclosed in Japanese Utility Model Unexamined Publication No. 131074/1988 can improve the function of sensing the incomplete insertion without fail, there is still room for further improvement. That is, under this arrangement, the strength of the housing lance itself is not improved. For example, when the strip 12 is pushed further under the condition that the front end portion of the strip 12 has slid onto the ushering surface 8*a* as shown in FIG. 7, there are cases where the housing lance 6 is deformed or damaged.

The reason is that the housing lance 6 is thin and projecting with one end thereof free and, in addition, that the sensing operation is performed with the strip 12 being pushed from the free end side of the housing lance 6. Thus, the housing lance is liable to deformation or damage. This shortcoming is keenly felt as connectors tend to be downsized.

SUMMARY OF THE INVENTION

The object of the invention is therefore to provide a connector capable of preventing the deformation and damage of the housing lance and surely sensing the incomplete insertion of a terminal into the connector housing.

To achieve the above object, the invention is applied to a connector that includes a housing lance that projects so as to be cantilever-like in a direction in which terminals are inserted into or extracted from a connector housing. The terminals inserted into the connector housing are held within the connector housing while latched by a holding projection arranged on the housing lance. The connector also includes a strip for preventing a terminal from coming out. The strip is designed to regulate flexion of the housing lance by being inserted from a front end side of the housing lance into a lance flexion gap arranged between the housing lance and an inner wall of the connector housing. In such a connector, a stepped portion is formed on a front end of the housing lance, the stepped portion having a holding surface facing a rear side of the housing lance. A housing inner surface projecting wall is also arranged at a position substantially confronting the holding surface in the connector housing, the housing inner surface projecting wall having a confronting holding surface being abuttable against the holding surface. As a result, when a front end of the strip has pushed the front end of the housing lance, the holding surface abuts against the confronting holding surface to thereby regulate positioning of the front ends.

In such a connector, the front end of the housing lance is pushed so as to face downward by the bottom surface of the female terminal if, e.g., the female terminal is incompletely inserted into the connector housing. As a result, the holding surface of the stepped portion arranged on the front end of the housing lance confronts the confronting holding surface of the housing inner surface projecting wall. When the strip for preventing a terminal from coming out gets inserted into the lower side of the housing lance under this condition, the strip abuts against the front end of the housing lance, causing the holding surface facing the rear side of the housing lance to abut against the confronting holding surface. As a result, the strip cannot be inserted any further.

Since the inserting force of the terminal holder can be received by the confronting holding surface through a small portion on the front end of the housing lance, the housing lance will not be subjected to further deformation or damage than that to which the housing lance is currently subjected, thereby preventing the connector from being assembled through forced insertion.

DETAILED DESCRIPTION OF THE PREFERRED EMBODIMENT

An embodiment of the invention will now be described in detail with reference to FIGS. 1 to 6.

Figure 1:
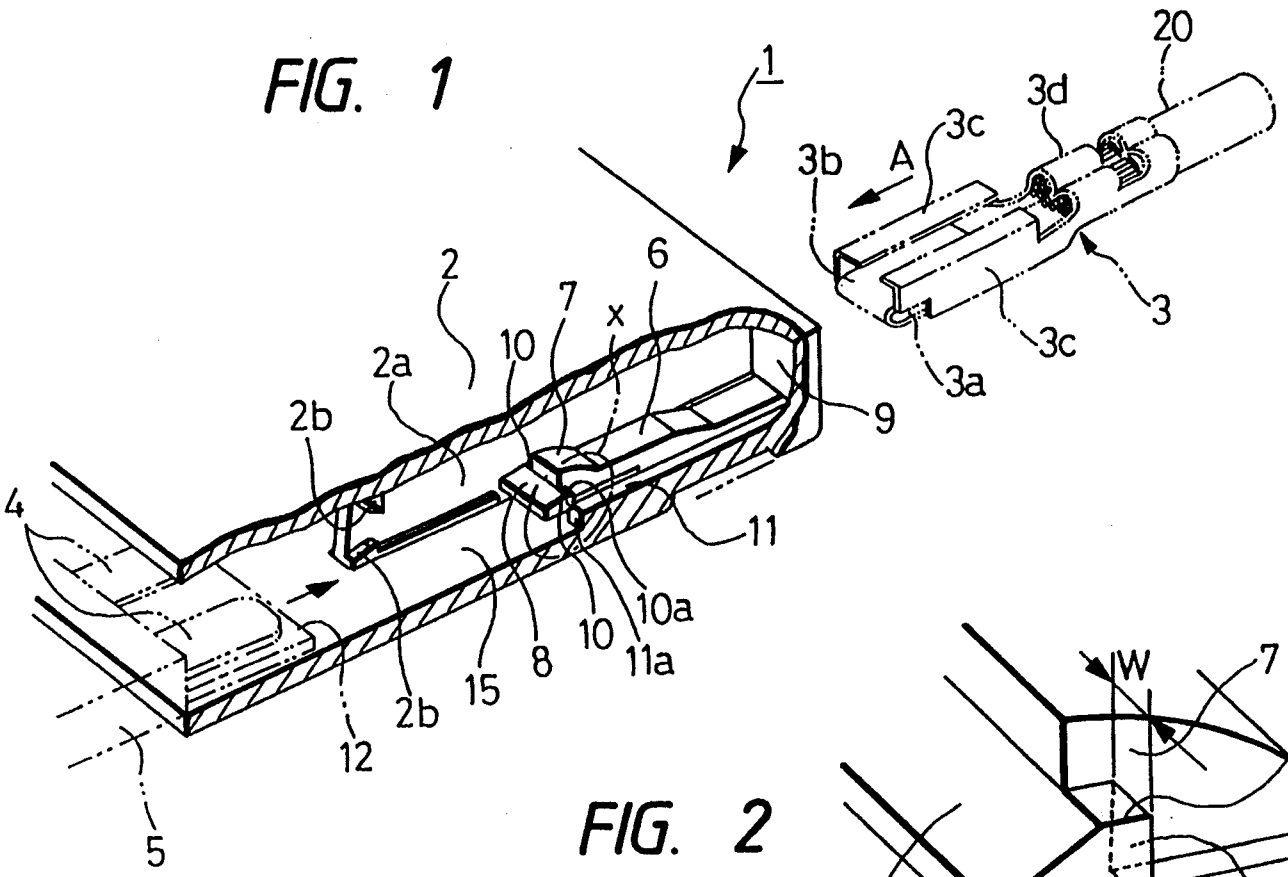
FIG. 1 is a partially cutaway exploded perspective view showing a connector, which is an embodiment of the invention.
Figure 2:
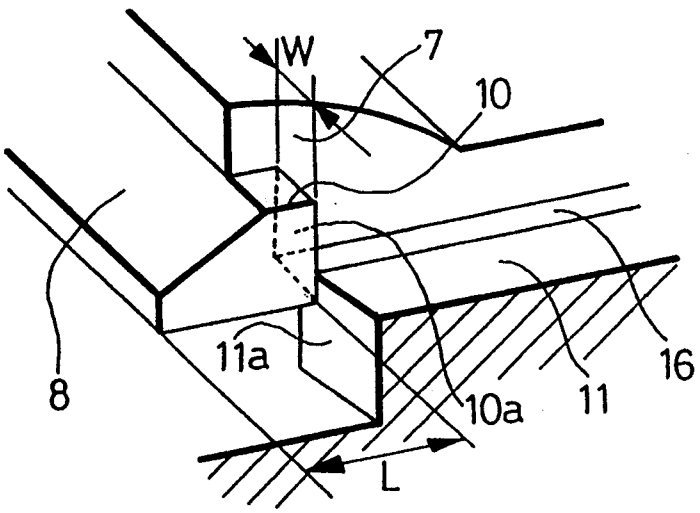
FIG. 2 is an enlarged perspective view showing the main portion (portion X) of FIG. 1.
Figure 3:
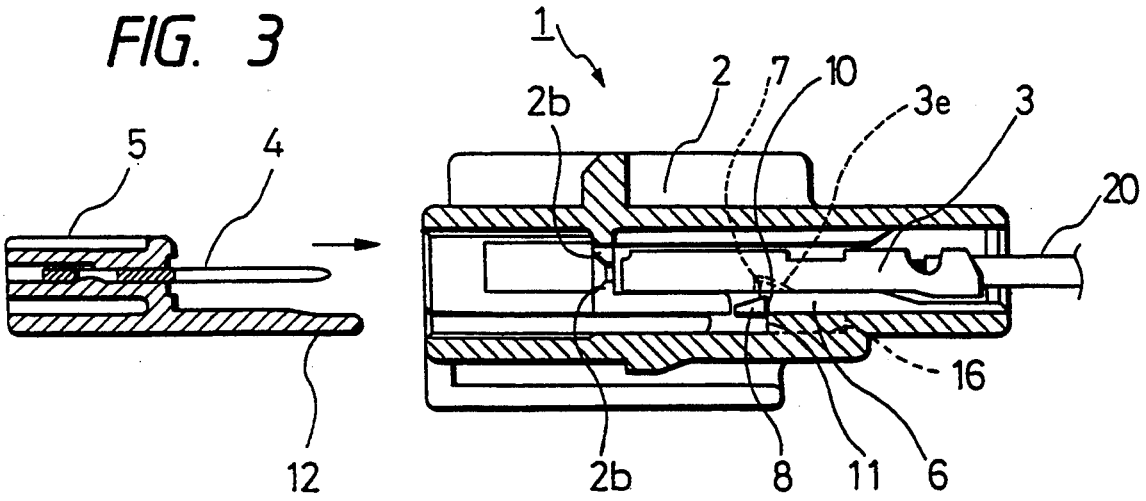
FIG. 3 is a schematic sectional view showing the main portion of the connector of FIG. 1 before connecting terminals.
Figure 4:
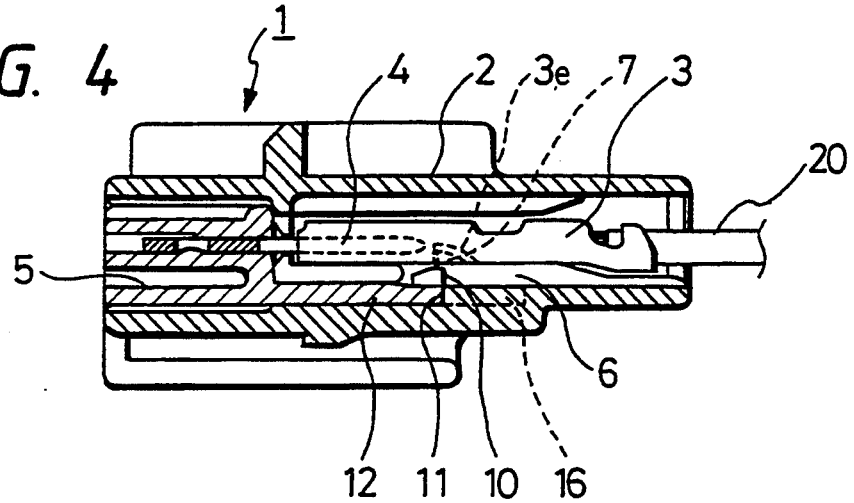
FIG. 4 is a schematic sectional view showing the main portion of the connector of FIG. 1 when the terminals are connected normally.
Figure 5:
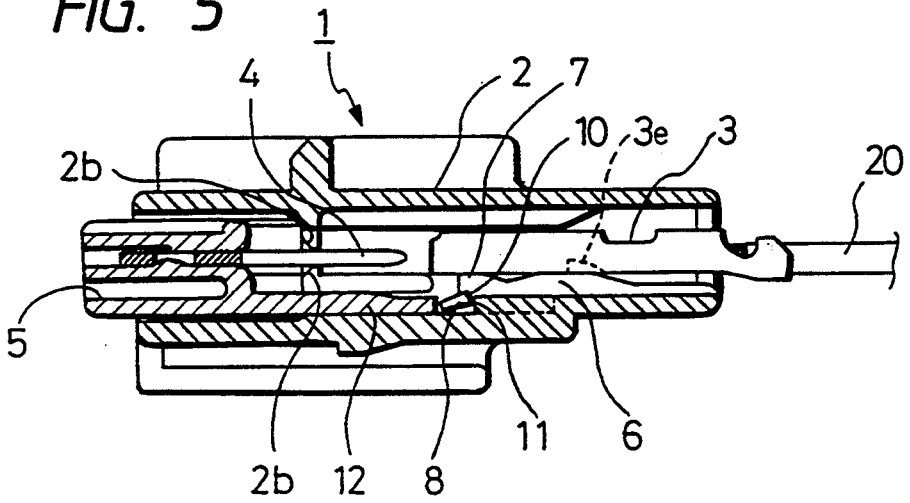
FIG. 5 is a schematic sectional view showing the main portion of the connector of FIG. 1 when the terminals are connected incompletely.
Figure 6:
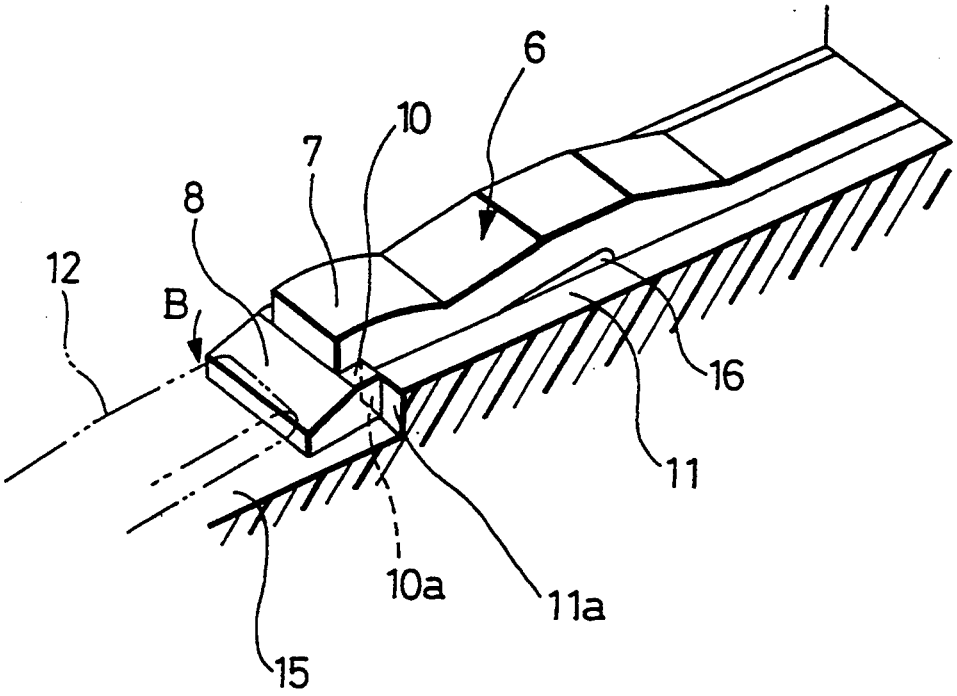
FIG. 6 is a perspective view showing the main portion of a condition in which a holding surface is fitted into a confronting holding surface of FIG. 2.
Figure 7:
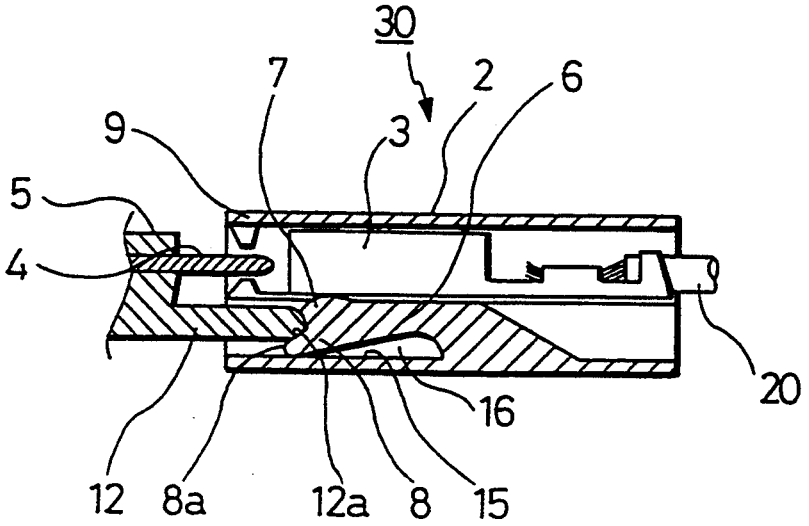
FIG. 7 PRIOR ART
FIG. 7 is a sectional view showing a conventional connector.

FIG. 1 is a partially cutaway exploded perspective view of a connector, which is the embodiment of the invention; FIG. 2 is an enlarged perspective view showing portion X of FIG. 1; FIG. 3 is a schematic perspective view showing a condition before a male terminal is inserted into the connector of FIG. 1; FIG. 4 is a schematic sectional view showing the normally inserted terminals; and FIG. 5 is a schematic sectional view showing the abnormally inserted terminals. These drawings are schematic sectional views taken along a cutting line at a position at which a housing lance is not cut in a connector housing shown in FIG. 1. FIG. 6 is a perspective view showing the main portion of the connector when a holding surface is fitted into a confronting holding surface shown in FIG. 2.

As shown in FIG. 1, a connector 1 in this embodiment roughly includes: a connector housing 2 having a plurality of terminal accommodating chambers 9; and a male terminal holder 5 for connecting female terminals 3 and male terminals 4. Each female terminal 3 is inserted into the corresponding terminal accommodating chamber 9, and each male terminal 4 is fitted into the corresponding female terminal 3.

While it goes without saying that the female terminal 3 has a shape corresponding to the terminal accommodating chamber 9 of the connector housing 2, as shown by a phantom line of FIG. 1, the female terminal 3 includes: a tongue **3*b* bent so as to fold back the end of a bottom strip 3*a* made of an appropriately shaped thin metal plate; a male terminal receiving portion having side strips 3*c*, both sides of the side strips 3*c* being bent substantially at right angles to and further in parallel with the bottom strip; and a lead connecting portion 3*d* for connecting a lead 20 as if by caulking. Further, a hole 3*e* (see FIGS. 3 to 5) for allowing a holding projection 7 arranged on the housing lance 6 (described later) to be fitted thereinto is formed on the bottom strip 3*a* of the female terminal 3**.

The male terminal holder 5 has a strip 12 for preventing a terminal from coming out (hereinafter referred to as "the strip 12"). The strip 12 extends from the holder body portion so as to prominently project from the male terminal 4 along the length of the male terminal 4. The holder body portion is substantially rectangular solid-shaped and made of a synthetic resin. Such holder body portion is formed by, e.g., molding a communicating portion (not shown) made of a metal and a plurality of male terminals 4 integrally. In this embodiment, a plurality of male terminals 4 corresponding to the number of terminal accommodating chambers 9 are arranged. The strip 12 is a plate-like member that is wider than the male terminal 4.

The male terminal holder 5 is pushed so that the male terminals 4 enter into the corresponding terminal accommodating chambers 9. At this point, the strip 12 is inserted into a lower side of the housing lance 6 (the side of a lance flexion gap 16, which will be described later) from a front end of the housing lance 6, so that the housing lance 6 is prevented from flexing.

The connector housing 2 is divided into a plurality of terminal accommodating chambers 9 by partitions **2*a* so that many terminals can be connected to each other. The section of each terminal accommodating chamber is rectangular. The cantilever-like housing lance 6 projects in the direction of inserting and extracting the terminals into and from the respective terminal accommodating chambers 9. That is, the housing lance 6 has a free end facing the male terminal. Each partition 2*a* has a tapered rib 2*b*, etc. for introducing the male terminal 4** to a regular position on the male terminal insertion side thereof.

Since the housing lance 6 has the lance flexion gap 16, which is a gap appropriately formed between the housing lance 6 and an inner wall 15 on the bottom of the connector housing, the front end portion of the housing lance 6 can move resiliently in the direction of narrowing the lance flexion gap 16. Therefore, the housing lance 6 is deformed appropriately when the female terminal 3 is inserted from the side of the base thereof (the direction of an arrow A), allowing the holding projection 7 thereof to be fitted into the hole formed on the base strip **3*a* of the female terminal 3 while biasing and holding the female terminal 3 appropriately, the holding projection 7 being formed so as to project faceup adjacent to a front end 8 of the housing lance 6**.

The design that the holding projection 7 is inclined so that the height thereof is lowered toward the base portion of the housing lance facilitates the insertion of the female terminal 3. In addition, the arrangement that a step such as to provide a wall surface facing the front end side of the housing lance is formed on the holding projection 7 allows the female terminal 3 to be held while latched at the position at which the female terminal 3 is completely inserted.

Further, stepped portions 10 (see FIG. 2), which are wider than outer portions of the housing lance 6, are formed on both sides, right and left, of the front end 8 of the housing lance 6. Holding surfaces 10*a* are formed on the respective stepped portions 10.

On the other hand, projecting walls 11 on the inner surface of the connector housing (hereinafter referred to as "the projecting wall 11") are formed on housing inner walls 15 positioned on both sides, right and left, of the housing lance 6. Each projecting wall 11 extends in the direction of projection of the housing lance. Each projecting wall 11 has a confronting holding surface 11*a*, which is formed at a position substantially confronting the holding surface 10*a*. The confronting holding surface 11*a* is designed so as to abut against the holding surface 10*a* when the front end 8 of the housing lance 6 is pushed toward the base side of the housing lance by the strip 12 as will be described later.

The connection and operation of the connector according to the invention will be described with reference to FIGS. 3 to 6.

By pushing the female terminal 3 into the connector housing 2, the housing lance 6 flexes so as to permit the entrance of the female terminal 3. Upon completion of the insertion of the female terminal 3, the holding projection 7 gets fitted into the hole of the female terminal 3. As a result, the female terminal 3 is held within the corresponding terminal accommodating chamber 9 (the condition shown in FIG. 3).

Under this condition, the male terminal holder 5 is inserted from the side opposite to the female terminal 3, so that the male terminal 4 is inserted into the female terminal 3 and the strip 12 enters into the lower portion of the housing lance 6, so that the movement of the housing lance 6 is regulated (the condition shown in FIG. 4). As a result, the fitting of the holding projection 7 into the hole of the female terminal 3 is maintained, which in turn maintains the connection between the terminals satisfactorily.

On the other hand, in the case where the female terminal 3 is inserted into the connector housing 2 incompletely (the condition shown in FIG. 5), the front end 8 faces downward (the direction of an arrow B of FIG. 6) with the holding projection 7 of the housing lance 6 being pushed by the bottom strip 3*a* of the female terminal 3. As a result, the holding surface 10*a* of the stepped portion 10 provided on the front end of the housing lance 6 is positioned so as to confront the confronting holding surface 11*a* of the projecting wall 11. If the male terminal holder 5 is inserted under this condition, the holding surface 10*a* facing the rear side of the lance abuts against the confronting holding surface 11*a* upon the strip 12 abutting against the front end 8 of the housing lance 6 as shown in FIG. 6.

Therefore, the strip 12 can no longer be inserted further from the condition in which both surfaces are abutted against each other. As a result, the male terminal holder 5 cannot be inserted any further, and this condition is used to sense an incomplete insertion of the female terminal 3. Further, the force for inserting the male terminal holder 5 can be received by the confronting holding surface 11*a* through the front end 8. As a result, the housing lance 6 is not deformed or damaged any more than what it is as in the conventional example, thereby not allowing the terminals to be inserted and assembled by force.

The connector of the invention is not limited to the embodiment shown in FIGS. 1 to 6. Therefore, the structure of the connector housing, the respective terminals and the terminal holder, etc. may be modified in various ways. Further, the stepped portions 10 are not necessarily arranged on both sides, right and left, of the housing lance 6, but may, of course, be arranged only on one side.

Still further, while the projecting wall 11 extends along the housing lance 6 in the above embodiment, the invention is not limited to such embodiment and may therefore be modified to an appropriate projecting shape. That is, as long as the confronting holding surface 11*a* that abuts against the holding surface 10*a* is provided, the projecting wall 1 may take various forms on condition that the position and shape is not to impede the insertion of the female terminal 3 and that there is no problem as to forming.

Still further, while the upper surface of the front end 8 of the housing lance 6 is tapered in the above embodiment, the upper surface may not necessarily be tapered. The thickness L and the projecting width W of the stepped portion 10 (see FIG. 2) are set to appropriate values in consideration of the material of which the housing lance 6 is made and the inserting pressure at the time of connecting the terminals. They are not specifically limited.

While the embodiment has been described with reference to a holder which is a male terminal holder having a strip for preventing a terminal from coming out, such holder may be formed as a counterpart connector having the strip. The above embodiment may also be applied to a female or male connector using the strip singly.

As described above, the invention is characterized as causing the holding surface of the stepped portion arranged on the front end of the housing lance to confront the confronting holding surface on the projecting wall of the connector housing when a terminal has been inserted in such an incomplete condition as to cause the front end of the housing lance to narrow the lance flexion gap. Under this condition, the holding surface facing the rear side of the housing lance abuts against the confronting holding surface when the strip for preventing a terminal from coming out has pushed the front end of the housing lance toward the rear side of the lance as such strip is being inserted into the lower side of the lance. As a result, such strip can no longer be inserted any further, which then allows the user to detect the incomplete insertion of the terminal far more surely than in the conventional example. In addition, the housing lance is free from any further deformation or damage, thus preventing the terminals from being assembled into the connector housing by force. Consequently, any fatal trouble of the connector due to damage of the housing lance or the like can be avoided.

What is claimed is:

1. A connector comprising:

a housing lance (6), the housing lance (6) projecting in a direction in which terminals (3), (4) are inserted into or extracted from a connector housing (2), the terminals (3), (4) inserted into the connector housing (2) being held within the connector housing (2) while latched by a holding projection (7) of the housing lance (6); and a terminal drop preventing strip (12) for preventing said terminals (3), (4) from being removed, said preventing strip (12) being inserted from a front end side of the housing lance (6) into a lance flexion gap (16) arranged between the housing lance (6) and an inner wall of the connector housing (2) so as to prevent said housing lance from being deflected toward said inner wall, wherein a stepped portion (10) is formed on a front end of the housing lance (6), the stepped portion (10) having a holding surface (10*a*) facing a rear side of the housing lance (6);

a projecting wall (11) on an inner surface of the connector housing (2) is arranged at a position substantially confronting the holding surface (10*a*) in the connector housing (2), the projecting wall (11) having a confronting holding surface (11*a*) abuttable against the holding surface (10*a*); and when a front end of the terminal drop preventing strip (12) has pushed the front end (8) of the housing lance (6), the holding surface (10*a*) abuts against the confronting holding surface (11*a*) to thereby regulate positioning of the respective front ends of the housing lance and the preventing strip.

2. A connector according to claim 1, in which the upper surface of the front end (8) of said housing lance (6) is tapered.

* * * * *